United States Patent [19]

Streetman et al.

[11] 4,205,039

[45] May 27, 1980

[54] PROCESS FOR MELT-SPINNING ACRYLONITRILE POLYMER FIBER

[75] Inventors: William E. Streetman, Gulf Breeze; Shashikumar H. Daftary, Pensacola, both of Fla.

[73] Assignee: American Cyanamid Company, Stamford, Conn.

[21] Appl. No.: 895,576

[22] Filed: Apr. 12, 1978

Related U.S. Application Data

[62] Division of Ser. No. 853,014, Nov. 17, 1977.

[51] Int. Cl.[2] ..... D01F 6/18

[52] U.S. Cl. ..... 264/206; 264/210.6; 264/210.7; 264/210.8; 264/211

[58] Field of Search ..... 264/206, 211, 210, 210.6, 264/210.7, 210.8; 260/29.6 AL, 29.6 AQ

[56] References Cited

U.S. PATENT DOCUMENTS

| | | | |
|---|---|---|---|
| 2,585,444 | 2/1952 | Coxe | 264/182 |
| 3,873,508 | 3/1975 | Turner | 264/206 |
| 3,896,204 | 7/1975 | Goodman et al. | 264/206 |
| 3,984,601 | 10/1976 | Blickenstaff | 264/206 |
| 3,991,153 | 11/1976 | Klausner et al. | 264/206 |

FOREIGN PATENT DOCUMENTS

| | | | |
|---|---|---|---|
| 2403947 | 8/1974 | Fed. Rep. of Germany | 264/206 |
| 51-60734 | 5/1976 | Japan | 264/206 |

*Primary Examiner*—Jay H. Woo

*Attorney, Agent, or Firm*—Frank M. Van Riet

[57] ABSTRACT

Spinning of a melt of water and an acrylonitrile polymer containing hydrophobic moieties through a spinnerette into a steam-pressurized solidification zone results in improved fiber when the amount of water in the melt is in the lower half of the range necessary to provide the melt under the conditions of extrusion, the amount of hydrophilic moieties contained in the polymer are sufficient to control the rate of release of water from the extrudate, the steam conditions in the solidification are sufficient to prevent formation of a separate water phase, and drying of the resulting extrudate under conditions of temperature and humidity to remove water therefrom while avoiding formation of a separate water phase.

6 Claims, No Drawings

PROCESS FOR MELT-SPINNING ACRYLONITRILE POLYMER FIBER

CROSS-REFERENCE TO RELATED APPLICATIONS

This application is a division of application Ser. No. 853,014, filed Nov. 17, 1977. This application relates to a process for melt-spinning acrylonitrile polymer fiber while the related application relates to a void-free acrylonitrile polymer fiber.

This invention relates to a process for melt-spinning an acrylonitrile polymer fiber of improved dye intensity and reduced shade change due to hot-wet processing. More particularly, this invention relates to such a process wherein control of critical steps prevents substantial formation of void structure which interferes with dyeing characteristics of the melt-spun fiber.

Recent developments in the art of spinning acrylonitrile polymer fibers have demonstrated that a modified melt-spinning procedure can provide a fiber. Such developments are illustrated by U.S. Pat. Nos. 3,896,204 issued July 22, 1975 to A. Goodman and M. A. Suwyn and 3,984,601 issued Oct. 5, 1976 to R. H. Blickenstaff, for example. In providing acrylonitrile polymer fiber according to these references, a homogeneous melt of acrylonitrile polymer and water is obtained by heating the proper amounts of polymer and water at elevated temperature and pressure. The polymer-water melt is extruded through a spinnerette whereupon it emerges into atmospheric pressure and is cooled. Because of the rapid loss of elevated pressure conditions, the water present in the hot nascent extrudate is violently released therefrom giving rise to a fiber that is characterized as having a sheath-core structure, a density gradient across the sheath, striations on the fiber surface, a significant void structure, and a luster arising from internally reflected light.

The presence of significant void structure within an acrylonitrile polymer fiber, however, is responsible for two serious deficiencies which adversely affect its commodity value. The void structure, because it reflects light, results in a fiber which is not transparent and severely reduces the dye intensity of the fiber necessitating marked increases in dye requirements to provide particular color shades and making the obtention of heavy shades, such as blacks and navy blues, impractical to achieve. In addition, the void structure, because it is unstable to hot-wet processing (changes form and distribution) causes severe shade changes in the dyed fiber when such fiber is subjected to hot-wet processing, which result further complicates the dyeing problems associated with these melt-spun acrylonitrile polymer fibers.

The dyeing deficiencies described above can best be appreciated by comparing the dyeing characteristics of such melt-spun acrylonitrile polymer fiber with those of a conventionally wet-spun acrylonitrile polymer fiber made from the same polymer. For comparison, a given weight of both fibers is dyed in separate dyeings under identical conditions with the same quantity of the same dye to achieve 100% dye pickup by both fiber samples. Arbitrarily, the depth of shade, or dye intensity, produced in the wet-spun fiber is assigned a value of 100 and the depth of shade produced in the melt-spun fiber is measured relative to this value. Results of such dyeings show that the dye intensity of the current melt-spun acrylonitrile polymer fibers is only about 35–40 relative to the wet-spun fiber. Such values are well below those values considered necessary for commercial acceptability.

The dyed fibers obtained in the comparison described above after dyeing are dried in air at room temperature (25° C.). A portion of each dyed fiber so dried is further oven dried at 300° F. for 20 minutes. Reflectances of the air dried and oven dried samples are measured and the shade changes determined. The results show that the current melt-spun acrylonitrile polymer fibers exhibit shade changes of 25–30 or more whereas the conventional wet-spun acrylonitrile polymer fibers show shade changes of 0–3. The shade changes exhibited by the current melt-spun acrylonitrile polymer fibers are too great for commercial acceptability.

There exists, therefore, the need for a process for melt-spinning acrylonitrile polymer fiber which avoids the deficiencies of the current processes and provides a substantially void free acrylonitrile polymer fiber having improved dye intensity and reduced shade change due to hot-wet processing. Such a provision would fulfill a long-felt need and constitute a significant advance in the art.

In accordance with the present invention, there is provided a process for preparing an acrylonitrile polymer fiber having a dye intensity of at least about 60 and a shade change of less than about 15 when subjected to hot-wet processing, which process comprises extruding a homogeneous single phase fusion melt of water and acrylonitrile polymer containing hydrophilic moieties through a spinnerette, the amount of water in said melt being in the lower half of the range required to provide a single-phase fusion melt under the conditions of extrusion and the amount of hydrophilic moieties contained in said polymer being sufficient to control the rate of release of water from the nascent extrudate in conjunction with processing and prevent substantial formation of a separate water phase therein; passing said nascent extrudate directly into a steam-pressurized solidification zone maintained under conditions of saturation and pressure to provide a solidified nascent extrudate and to prevent substantial formation of a separate water phase in the solidified extrudate while removing water from said extrudate; releasing the solidified extrudate from said steam-pressurized solidification zone into the atmosphere to provide a solidified extrudate containing residual water in a single water-polymer phase; and drying the resulting extrudate under conditions of temperature and humidity to remove water therefrom while avoiding the substantial formation of a separate water phase therein.

The process of the present invention provides a melt-spun substantially void free acrylonitrile polymer which has a dye intensity of at least about 60, preferably at least about 75 or more, and a shade change due to hot-wet processing of less than about 10 or lower. The process provided by the present invention leads to a commercially acceptable melt-spun acrylonitrile polymer fiber and thus enables the benefits of melt-spinning to be applied thereto in a practical manner. Surprisingly, the process of the present invention in providing an acrylonitrile polymer fiber that is commercially acceptable avoids those various fiber characteristics that distinguish the current melt-spun acrylonitrile polymer fibers from the conventional wet-spun or dry-spun acrylonitrile polymer fibers.

In carrying out the process of the present invention, there are four critical features that must be satisfied if the desired fiber is to be achieved. Elimination of any one of these features will lead to significant void structure, reduced dye intensity, increased shade change due to hot-wet processing and thus defeat the object of the present invention.

A first critical feature of the process of the present invention is the necessity of employing as the fiber-forming acrylonitrile polymer one containing a suitable amount of hydrophilic moieties. The use of acrylonitrile polymers devoid of hydrophilic moieties will not provide a void free fiber structure when melt-spun as a fusion melt with water even if other processing features are satisfied.

A second critical feature of the present invention is the necessity to use an amount of water in the single phase fusion melt that is in the lower half of the range that will provide such a melt under the conditions of extrusion contemplated. Use of too little water will of course fail to provide a single phase fusion melt while use of too much water will result in significant void structure in the fiber even if other processing features are satisfied.

A third critical feature is that of passing the nascent extrudate directly into a steam-pressurized solidification zone maintained under suitable conditions of saturation and pressure. Passing the nascent extrudate directly into solidification zones maintained under other conditions will result in uncontrolled release of water therefrom which causes foaming of the extrudate and leads to formation of a separate water phase therein which, upon subsequent processing leads to significant void structure. Failure to provide for passing the nascent extrudate directly into the steam-pressurized solidification zone results in significant void structure in the fiber even if other processing features are satisfied.

A fourth critical feature is that of drying the solidified extrudate released from the solidification zone under the proper conditions of temperature and humidity to remove residual water therefrom. Even if all three of the critical features previously enumerated have been satisfied, failure to satisfy this fourth critical feature will still lead to significant void structure in the resulting fiber.

In the further discussion of the process of the present invention which follows, certain expressions are used which require definition and these definitions are now given.

By the expression "acrylonitrile polymer" is meant a polymer containing at least 50 weight percent acrylonitrile units and any balance of one or more monomer or polymer units with which acrylonitrile is polymerizable, so long as the requirement for hydrophilic moieties is satisfied.

By the expression "hydrophilic moieties" is meant those portions of the acrylonitrile polymer that are readily hydrated at normal conditions of temperature and pressure. Such moieties are capable of binding water under conditions of temperature and pressure at which nitriles do not bind water or lose water bound at higher conditions of temperature and pressure. Typical hydrophilic moieties include, for example, sulfonic acid groups, polyvinyl alcohol segments, carboxylic acid groups, amide groups, hydroxyl groups, imidazoline groups, and the like.

By the expression "substantially void free" and similar expressions is meant that the extrudate or fiber is sufficiently free of void-structure therein to enable at least the minimum value of dye intensity to be obtained and a value of shade change due to hot-wet processing below about 10 to be obtained.

By the expression "dye intensity" is meant, as indicated above, the relative dye shade achieved compared to that of a wet-spun fiber of the same polymer dyed in the same manner with the same amount of dye.

By the expression "shade change due to hot-wet processing" is meant the change in reflectance of a dyed fiber which has been air dried at room temperature after dyeing compared to dyed fiber which is dried at 300° F. for 20 minutes after dyeing.

By the expression "homogeneous single phase fusion melt" is meant a composition of liquid form in which the components thereof are uniformly distributed therein to provide a unitary system in which individual ingredients are indistinguishably fused together. Such compositions of acrylonitrile polymer and water are known in the art.

The content of hydrophilic moieties present in the acrylonitrile polymers useful in the process of the present invention will vary widely depending upon the nature of the hydrophilic moieties employed, the content of acrylonitrile in the polymer, the presence or absence of more than one type of hydrophilic moiety, the molecular weight of the polymer, the nature of the acrylonitrile polymer and the like. In view of the vast variety of useful acrylonitrile polymers as fiber-forming polymers, it is not possible to specify a meaningful range of content of hydrophilic moieties that would be applicable for all acrylonitrile polymers contemplated. However, a useful content can readily be determined following the principles set forth herein.

The content of hydrophilic moieties in the useful acrylonitrile polymer may arise in numerous ways. A first procedure for introducing such moieties into the acrylonitrile polymer is to copolymerize acrylonitrile with suitable quantities of a hydrophilic comonomer, such as acrylamide, acrylic acid, acrylamidomethylpropane sulfonic acid, hydroxypropylacrylate and allyl alcohol. Another procedure is to polymerize the monomer content which is to provide the acrylonitrile polymer in the presence of a redox initiator system which introduces hydrophilic end groups at the polymer chain ends, such as sulfonic acid groups. Yet another method is to polymerize the monomer content in the presence of a pre-formed hydrophilic polymer, such as polyvinylalcohol, polyacrylic acid, polyvinylpyrrolidone, polyethylene glycol, polyacrylamide, and polypropylene glycol. Still another procedure is to hydrolyze a suitable proportion of the acrylonitrile units of a pre-formed acrylonitrile polymer to provide hydrophilic moieties such as carboxylic acid and/or amide groups. Further, a portion of the acrylonitrile units of a pre-formed acrylonitrile polymer can be modified by suitable reaction to form hydrophilic units, such as by reaction with ethylenediamine to provide imidazoline groups, for example. These and other methods known to those skilled in the art can be used alone or in combination to provide or augment the content of hydrophilic moieties in the acrylonitrile polymer.

The content of hydrophilic moieties necessary in a given acrylonitrile polymer is that amount which controls the rate of release of water from the nascent extrudate to prevent void formation due to rapid release of water vapor therefrom or formation of a separate water phase therein as the nascent extrudate is solidified in the steam-pressurized solidification zone. The amount of such hydrophilic moieties present in the acrylonitrile polymer should be sufficient to control release of water from the nascent extrudate as indicated in conjunction with processing conditions but should not be so great as to adversely affect the fiber-forming properties of the acrylonitrile polymer. It is believed that the hydrophilic moieties are capable of binding and releasing, i.e. transporting, water from within the fiber structure at controllable rates. When the composition of acrylonitrile polymer and water is at melt temperature and pressure, water is bound by nitrile groups as well as hydrophilic moieties. As the temperature and pressure are reduced when the nascent extrudate is in the steam-pressurized solidification zone, water is released from the nitrile groups and transported by the hydrophilic moieties outside the extrudate structure, preventing formation of void structure due to rapid release of water from the extrudate composition and formation of a separate water phase within the extrudate structure. This transport of water from within the extrudate structure to the outside thereof continues as the extrudate remains in the steam-pressurized solidification until the water content is temporarily stabilized without formation of a significant void structure or a separate water phase within the extrudate. The thus-solidified and partially dried extrudate can then safely emerge into the atmosphere and be further processed, including removal of residual water therefrom.

The acrylonitrile polymer will contain at least 50 weight percent of acrylonitrile and sufficient hydrophilic moieties as indicated. The balance of the composition may comprise one or more of the following monomers:

HYDROPHOBIC MONOMERS

Methyl methacrylate, ethyl acrylate, butyl acrylate, methoxymethyl acrylate, beta-chloroethyl acrylate, and the corresponding esters of methacrylic acid and chloroacrylic acid; vinyl chloride, vinyl fluoride, vinyl bromide, vinylidene chloride, vinylidene bromide, allyl chloride, 1-chloro-1-bromoethylene; methacrylonitrile; methyl vinyl ketone; vinyl formate, vinyl acetate, vinyl propionate, vinyl stearate, vinyl benzoate; N-vinyl phthalimide, N-vinyl succinimide; methylene malonic esters; itaconic esters; N-vinyl carbazole; vinyl furan; alkyl vinyl esters; diethyl citraconate, diethylmesaconate; styrene, dibromostyrene; vinyl naphthalene; 2-methyl-1-vinylimidazole, 4-methyl-1-vinylimidazole, 5-methyl-1-vinylimidazole; and the like.

HYDROPHILIC MONOMERS

Acrylic acid, methacrylic acid, alphachloroacrylic acid, itaconic acid, vinyl sulfonic acid, styrene sulfonic acid, methallyl sulfonic acid, p-methoxyallyl benzene sulfonic acid, acrylamidomethylpropane sulfonic acid, ethylene-$\alpha,\beta$-dicarboxylic acids and their salts; acrylamide, methacrylamide, dimethylacrylamide, isopropylacrylamide; allyl alcohol; 2-vinylpyridine, 4-vinylpyridine, 2-methyl-5-vinylpyridine; vinylpyrrolidone; vinylpiperidone; 1,2-dihydroxypropylmethacrylate, hydroxyethyl methacrylate; 1-trimethylammonium-2-hydroxypropyl methacrylate methosulfate; and the like.

Having selected a suitable acrylonitrile polymer containing hydrophilic moieties, as indicated, it is next necessary to provide a homogeneous single phase fusion melt using about the minimum amount of water necessary to obtain such melt under the conditions of extrusion contemplated. A suitable procedure for determining the proper composition of the fusion melt is to construct a phase diagram from various compositions of polymer and water as a function of temperature under sufficient pressure to maintain water in liquid state. Such a diagram will provide a minimum fusion melt melting point, a temperature below which the polymer will not melt regardless of the quantity of water present. At this minimum fusion melt melting point there will be only one precise quantity of water that will provide a single phase fusion melt, lower quantities of water providing a two phase system containing a fusion melt as one phase and a second phase of unmelted polymer and higher quantities of water providing a two phase system containing a fusion melt as one phase and a second phase or water. As the temperature is increased above the minimum fusion melt melting point, the amount of water which will provide a single phase fusion melt will constitute a range of values, the range increasing with increasing temperature values. The range of useful amounts of water will constitute a minimum value below which a single phase fusion melt cannot be obtained and a maximum value above which a single phase fusion melt will not be obtained.

To illustrate the composition of the single phase fusion melt with increasing temperature, the following hypothetical situation is appropriate. Assume that a typical polymer composition has a minimum single phase fusion melt melting point temperature of 150° C. and forms such melt at a composition of 100 parts polymer and 25 parts water. If the melt temperature is raised to 160° C., the amount of water that could provide the single phase fusion melt might range from 20 to 30 parts per 100 parts of polymer. In accordance with the present invention, the amount of water to be employed in forming the single phase fusion melt will be in the lower half of the range necessary at the temperature of extrusion to be employed. Thus, in the hypothetical situation, the amount of water will be about 20–25 parts per 100 parts of water when extrusion is conducted at 160° C.

Having determined the composition of the single phase fusion melt, as well as the polymer composition and extrusion temperature, as indicated, the fusion melt is extruded through a spinnerette directly into a steam-pressurized solidification zone. This solidification zone is above atmospheric pressure due to the steam pressure and is at temperature and saturation sufficient to provide a solidified nascent extrudate and to prevent formation of a separate water phase in the solidified extrudate while removing water therefrom. The steam pressure should provide a temperature at which the extrudate will solidify and such temperature will be dependent upon the polymer composition employed, the water content of the fusion melt, and the temperature of extrusion. By use of the steam pressurized solidification zone, rapid release of water vapor from the nascent extrudate as occurs when the nascent extrudate enters directly into the atmosphere or other environments is avoided. The use of the lower range of amounts of water in forming the fusion melt aids in avoiding rapid release of water vapor and reduces the total amount of water to be removed from the extrudate in avoiding formation of a separate water phase therein. The use of a polymer composition containing hydrophilic moieties therein enables transport of water from within to without the nascent extrudate while avoiding formation of a separate water phase therein.

The steam pressure employed in the solidification zone will determine the temperature therein and, accordingly, will control the temperature of the extrudate while in the solidification zone. Since the amount of water present in the fusion melt and the polymer composition will influence the temperature at which the nascent extrudate soldifies, it is not possible to state a meaningful range of steam pressures that will encompass all combinations of polymer compositions and water contents of the fusion melt. However, from the phase diagram of water and polymer composition which was used to determine the minimum water content and temperature of extrusion, a suitable solidification temperature can be ascertained. Generally, the solidification temperature will be at least about 10 degrees below the melting point of the fusion melt of the water content and polymer content employed, but generally not more than about 45 degrees below such melting point. Within this range, proper solidification occurs without the formation of a separate water phase and processing is readily accomplished.

In a preferred embodiemnt of the present invention, the nascent extrudate is subjected to orientation stretching while in the steam pressurized solidification zone so as to take advantage of the conditions prevailing therein. The extrudate while in the steam pressurized solidification zone, although solidified, is in a plastic state and can readily respond to stretching forces. It is generally possible to apply stretch ratios in the range of 25 or greater in one or more stretches. Such stretching not only improves physical properties of the subsequent fiber but also enables a wide range of fiber denier to be obtained from a given size of spinnerette orifice.

As the extrudate emerges from the steam pressurized solidification zone, it enters the atmosphere through a suitable pressure retaining outlet. The extrudate will contain residual water in a single polymer water phase which is stable to further processing. Residual water must be removed from the extrudate under conditions of humidity and temperature which avoid the formation of a separate water phase in the extrudate. Generally, such conditions will involve dry bulb temperatures in the range of about 120°-180° C. and wet bulb temperatures in the range of about 60°-100° C. for a sufficient time to remove residual water that could form a separate water phase in the eventual fiber structure. Although other processing steps may be performed prior to removal of residual water from the solidified extrudate, it is necessary to conduct removal of residual water prior to the occurrence of any uncontrolled or tensionless shrinkage of the extrudate has occurred. This water removal step may be conducted on the extrudate in a free-to-shrink condition or under tension. After removal of residual water as indicated, such additional processing steps as are consistent with conventional processing may be conducted as desired.

The invention is more fully illustrated by the examples which follow wherein all parts and percentages are by weight unless otherwise specified.

In the examples which follow, dye intensity and shade change values are given. These values are obtained in accordance with the following procedures.

DYE INTENSITY

A sample of fiber is dyed with Basic Blue 1 at 0.5 weight percent, based on the weight of fiber, to complete exhaustion. The dyed sample is then dried in air at room temperature and a reflectance measurement is made versus a control using the Color-Eye at 620 millimicrons. The control sample is a commercial wet spun acrylic fiber of the same denier dyed and handled in the same manner as the experimental fiber. The result is reported as the percent reflectance of that achieved by the control. In the case where the experimental fiber has more void structure than the control, there will be more light scattered and the dyed experimental fiber will register less than 100% reflectance at 620 millimicrons. The fiber will also appear to the eye to be lighter in color than the control.

SHADE CHANGE

A twenty gram sample of carded and scoured fiber is dyed with 0.5 weight percent of Basic Blue 1 based on the weight of fiber, at the boil until complete exhaustion occurs. One portion of the dyed fiber is dried in air at room temperature. Another portion is dried in an oven at 300° F., for 20 minutes. Reflectances of both samples are obtained using the Color-Eye at 620 millimicrons. The change in reflectance of the oven-dried sample relative to the reflectance of the air dried sample is the shade change.

EXAMPLE 1

A polymer of 89.3 weight percent acrylonitrile units and 10.7 weight percent methyl methacrylate units prepared with a redox system of sodium persulfate and sodium metabisulfite as initiator was produced by suspension polymerization obtaining a polymer of molecular weight of 48,000 (Mk). End groups of the polymer contained sufficient sulfonic acid groups to provide a sulfur content of 0.167 weight percent.

To 82.3 parts of polymer were added 17.7 parts of water to provide a composition for a fusion melt. The composition was heated in conjunction with a screw extruder to provide a single phase fusion melt which was extruded through a spinnerette having 9060 orifices each of a diameter of 120 microns. The melt zone of the extruder was 190° C. and the pump outlet temperature was 200° C. Production rate was 60 pounds per hour. The extrudate was extruded directly into a steam pressurized solidification zone maintained at a saturated steam pressure of 20 lbs./sq. inch gauge. The extrudate while within the steam pressurized solidification zone was stretched in a first stage at a ratio of 3.7 and in a second stage at a ratio of 12.0 relative to the linear speed of the fusion melt through the spinnerette to provide a total stretch ratio of 44.3. The fiber as produced had a denier of 2.4 per filament. The fiber was divided into three portions and further processed as follows:

A first portion was conventionally processed for comparison purposes. The stretched filaments were subjected to steaming in an autoclave at a steam pressure of 11 lbs. for 15 minutes, the filament being in a free-to-shrink condition. A shrinkage of 30% occurred, providing a fiber of 3.4 denier/filament. This fiber had a dye intensity of 40 and a shade change of 13 when subjected to hot-wet processing.

A second portion of the stretched filaments was subjected to drying in a free-to-shrink state at a dry bulb temperature of 150° C. and a wet bulb temperature of 90° C. for 20 minutes. The filaments were then subjected to steaming in an autoclave at a steam pressure of 11 lbs. for 15 minutes, the filaments being in a free-to-shrink condition. A shrinkage of 30% occurred providing a fiber of 3.4 denier/filament. This fiber had a dye intensity of 62 and a shade change of 13.

A third portion of the stretched filaments were subjected to conditioning in a free-to-shrink state at a dry bulb temperature of 150° C. and a wet bulb temperature of 90° C. for 20 minutes. The filaments were then subjected to dry heat for 3 minutes at 200° C. in a free-to-shrink state. A shrinkage of 21% occurred, provided a fiber of 3.0 denier per filament. This fiber had a dye intensity of 62 and a shade change of 5.

EXAMPLE 2

The polymer employed had a molecular weight of 41,000 (Mk) and a content of:

| Monomer | Weight % |
|---|---|
| Acrylonitrile | 87.0 |
| Methyl methacrylate | 2.0 |
| Methacrylonitrile | 10.0 |
| Acrylamidomethylpropane sulfonic acid | 1.0 |

To 82 parts of polymer were added 18 parts of water and 0.25 parts of zinc stearate as lubricant. The polymer-water mixture was processed using a screw extruder and spinnerette with 2,937 holes, each of 160 micron diameter. The melt temperature was 197° C. and the pump outlet was 171° C. The polymer melt was extruded at a rate of 36 lbs/hr. into a steam pressurized solidification zone maintained at a saturated steam pressure of 20 lbs./sq. inch gauge. The extrudate was stretched while in the solidification zone in two stages to achieve a stretch ratio of 7.6 in the first stage and a total stretch ratio of 37.1, relative to the linear speed of the melt through the spinnerette, to achieve a filament of 5 deniers.

A stretched filament was conditioned in a free-to-shrink state for 20 minutes in an oven maintained at a dry bulb temperature of 150° C. and a wet bulb temperature of 90° C. The conditioned fiber was then autoclaved at a steam pressure of 11 lbs. for 15 minutes in a free-to-shrink condition. The filament underwent 23% shrinkage resulting in a fiber of 7.1 denier per filament. The fiber exhibited a dye intensity of 63 and a shade change of 14.

EXAMPLE 3

The procedure of Example 2 was followed except for the following. The polymer was of 40,000 (Mk) molecular weight and had the following composition:

| Monomer | Weight % |
|---|---|
| Acrylonitrile | 87.5 |
| Methyl methacrylate | 11.5 |
| Acrylamidomethylpropane sulfonic Acid | 1.0 |

To 86.6 parts of polymer were added 13.4 parts water and 0.25 parts of a glycerol stearate type lubricant. the spinnerette had 2937 holes, each of 120 micron diameter, the melt temperature was 172° C. and the pump outlet was at 153° C. The polymer melt was processed at 35 lbs/hr. and stretching was in two stages, a stretch ratio of 5.5 in a first stage and a total stretch ratio of 42.9 were achieved to provide a filament of 3.7 deniers. The fiber was conditioned and autoclaved as in Example 2 during which processing 30% shrinkage occurred yielding a fiber of 5.3 denier/filament. The fiber had a dye intensity of 72 and a shade change of 13.

EXAMPLE 4

The procedure of Example 2 was again followed. The polymer had a molecular weight of 49,000 (Mk) and was obtained by polymerizing acrylonitrile and methyl methacrylate in the presence of polyvinyl alcohol such that the final composition contained 82.5 parts acrylonitrile, 11.0 parts methyl methacrylate and 6.5 parts polyvinyl alcohol. To 79.5 parts of polymer were added 20.5 parts water and 0.25 parts of glycerol stearate type lubricant. The polymer melt temperature was 178° C. and the pump outlet was 161° C. The melt was extruded at 28 lbs./hr. Stretching was at a stretch ratio of 3.7 in a first stage and 34.1 total to yield a filament of 5 denier. The filaments were conditioned as in Example 2 during which processing 32% shrinkage occurred yielding a fiber of 8.0 denier per filament. The fiber had a dye intensity of 74 and a shade change of 5.

EXAMPLE 5

The procedure of Example 2 was again followed. The polymer was again prepared in the pesence of polyvinyl alcohol such that the final composition contained 84.1 parts acrylonitrile, 11.9 parts methyl methacrylate, 0.5 parts acrylamidomethylpropane sulfonic acid and 3.5 parts polyvinyl alcohol. The polymer had a molecular weight of 41,900 (Mk). To 82 parts of polymer composition were added 18 parts water and 0.25 parts of a glycerol stearate type lubricant. The spinnerette had 2937 holes each of 120 micron diameter. The polymer melt was at 178° C. and pump outlet at 166° C. The melt was extruded at 28 lbs./hr. Stretching was in a first stage at a stretch ratio of 3.4 and total stretch ratio was 18.6 to provide a filament denier of 3. The filaments were conditioned as in Example 4 during which processing shrinkage of 30% occurred to yield a fiber of 5 denier/filament. The fiber had a dye intensity of 81 and a shade change of 15.

EXAMPLE 6

The procedure of Example 5 was repeated using the same polymer composition. To 84.8 parts polymer composition were added 15.2 parts water and 0.25 part of glycerol stearate type lubricant. The polymer melt was at 175 and pump outlet at 162° C. The polymer melt was processed at 33 lbs./hr. A first stage stretch was at a ratio of 3.4 and total stretch ratio was 29.2 to yield a filament denier of 3. The filaments were conditioned in a free-to-shrink state at a dry bulb temperature of 138° C. and a wet bulb temperature of 74° C. for 20 minutes followed by autoclaving at 11 lbs steam for 15 minutes during which processing 30% shrinkage occurred to yield a fiber of 4.6 denier per filament. The fiber had a dye intensity of 77 and a shade change of 12.

EXAMPLE 7

The process of Example 5 was again repeated using the same polymer composition. To 82.7 parts polymer composition were added 17.3 parts water and 0.25 parts of a glycerol stearate type lubricant. The melt was at 175° C. and the pump outlet at 158° C. The melt was extruded at 33 lbs./hr. A first stage stretch was at a ratio of 3.2 and total stretch was at a ratio of 28.6 to provide a filament denier of 3. The fiber was conditioned as in Example 5 and during such processing 30% shrinkage occurred to provide a fiber of 5.0 denier per filament. The fiber had a dye intensity of 83 and a shade change of 9.

We claim:

1. A process for preparing an acrylonitrile polymer fiber having a dye intensity of at least about 60 and a shade change of less than about 15 when subjected to hot-wet processing, which process comprises extruding a homogeneous single phase fusion melt of water and acrylonitrile polymer containing hydrophilic moieties chemically bonded therein through a spinnerette, the amount of water in said melt being in the lower half of the range of amounts required to provide a single phase fusion melt under the conditions of extrusion and the amount of hydrophilic moieties contained in said polymer being sufficient to control the rate of release of water from the nascent extrudate in conjunction with processing and prevent substantial formation of a separate water phase; passing said nascent extrudate directly into a steam-pressurized solidification zone maintained under conditions of saturation and pressure to provide a solidified nascent extrudate and to prevent the substantial formation of a separate water phase in the solidified exrudate while removing water from said extrudate; releasing the solidified extrudate from said steam-pressurized solidification zone into the atmosphere to provide a solidified extrudate containing residual water in a single water-polymer phase; and drying the resulting extrudate under conditions of temperature and humidity indicated by a dry bulb temperature in the range of about 120°-180° C. and a wet bulb temperature in the range of about 60°-100° C. to remove water therefrom and to avoid the substantial formation of a separate water phase therein.

2. The process of claim 1 wherein the acrylonitrile polymer has sulfonic acid end groups sufficient to provide a sulfur content of 0.167 weight percent.

3. The process of claim 1 wherein the acrylonitrile polymer comprises 87 weight percent acrylonitrile, 2 weight percent methyl methacrylate, 10 weight percent methacrylonitrile, and 1 weight percent acrylamidomethylpropane sulfonic acid.

4. The process of claim 1 wherein the acrylonitrile polymer comprises 87.5 weight percent acrylonitrile, 11.5 weight percent methyl methacrylate, and 1.0 weight percent acrylamidomethylpropane sulfonic acid.

5. The process of claim 1 wherein the acrylonitrile polymer is obtained by polymerizing 82.5 weight percent acrylonitrile and 11.0 weight percent methyl methacrylate in the presence of 6.5 parts polyvinyl alcohol.

6. The process of claim 1 wherein the acrylonitrile polymer is obtained by polymerizing 84.1 weight percent acrylonitrile, 11.9 weight percent methyl methacrylate, and 0.5 weight percent acrylamidomethylpropane sulfonic acid in the presence of 3.5 weight percent polyvinyl alcohol.

* * * * *